US006527815B1

(12) United States Patent
Bryant et al.

(10) Patent No.: US 6,527,815 B1
(45) Date of Patent: Mar. 4, 2003

(54) GARMENT DYEING

(75) Inventors: Katherine T. Bryant, Greensboro, NC (US); John E. Newbern, Forest, VA (US); Earl E. Bradsher, III, Penhook, VA (US); Terry L. Currans, Alexander City, AL (US); G. Lewis Best, III, Lynchburg, VA (US); Ashutosh Karnik, Burlington, NC (US); John W. McAnulty, Asheboro, NC (US)

(73) Assignee: Burlington Industries, Inc., Greensboro, NC (US)

( * ) Notice: Subject to any disclaimer, the term of this patent is extended or adjusted under 35 U.S.C. 154(b) by 120 days.

(21) Appl. No.: 09/661,640

(22) Filed: Sep. 13, 2000

(51) Int. Cl.[7] ..... D06P 3/80; D06P 5/20; D06P 7/00

(52) U.S. Cl. ..... 8/529; 8/531; 8/532; 8/533; 8/534; 8/922; 8/924; 8/930; 8/932; 8/934

(58) Field of Search ..... 8/529, 531–534, 8/922, 924, 930–934

(56) References Cited

U.S. PATENT DOCUMENTS 4,056,354 A 11/1977 Pittman et al.
4,260,389 A 4/1981 Lister
4,289,496 A 9/1981 Lister
4,828,571 A 5/1989 Pensa et al.
4,835,053 A * 5/1989 Stanko
4,845,789 A 7/1989 Morton et al.
4,920,001 A 4/1990 Lee et al.
5,019,131 A 5/1991 Nitsch, Jr.
5,639,282 A * 6/1997 Buhler

OTHER PUBLICATIONS

American Dyestuff Reporter Aug. 1988 p. 40, 42+ ISSN: 0002–8266 Developing Novel Effects to Enhance Garment Dyeing (abstract).
Teli U. of Bombay Indian J. of Fibre & Textile Research 21, No. 1:41+, 9 pages Mar. 1996 New Developements in Dyeing Process Control (abstract).
Int. Dyer, Textile Printer, Bleacher and Finisher 176, No. 6: 10–11 Jun. 1991 Firmly Committed to Dytex Customer (ab).
Houser Amer. Dyestuff Reporter 80, No. 5: 18, 20, 23, 50 May 1991 Garment dyeing—Is it Here to Stay? (abstract).
Amer. Dyestuff Reporter, p. 24 May 1991 Understanding the Basics in Garment Dyeing (abstract).

* cited by examiner

*Primary Examiner*—Margaret Einsmann
(74) *Attorney, Agent, or Firm*—Nixon & Vanderhye P.C.

(57) ABSTRACT

Textiles made of synthetic fibers and synthetic fiber blended fabrics are constructed in the form of a garment then dyed while avoiding setting permanent creases and permanent wrinkles in the garment. The process includes selecting a synthetic or synthetic blended fabric for the dyeing process by determining the fabric's shrinkage in the warp and fill directions, for instance no greater than 6%, constructing a garment from the fabric selected, then dyeing the constructed garment in an aqueous dyebath at a temperature in the range of 220 to 260° F. for a time sufficient to achieve a desired shade and levelness of color followed by drying and optionally pressing the dyed garment.

8 Claims, No Drawings

GARMENT DYEING

This invention relates to dyeing synthetic fiber and synthetic fiber blend textiles constructed in the form of a garment while avoiding setting permanent creases and permanent wrinkles in the garment during the dyeing process.

BACKGROUND OF THE INVENTION

There is an existing need to provide garments constructed of synthetic fabrics and/or synthetic fiber blended fabrics in a range of colors free from permanent wrinkles, garment distortion and garment size variations. This invention provides an aqueous-based dyeing process that uniformly dyes garments made of synthetic fiber and/or synthetic fiber blended fabric without allowing the dyeing process to set permanent creases and permanent wrinkles in the garment.

Various prior proposals have been made for dyeing synthetic fabrics at elevated temperatures, that is at or above the boiling point. U.S. Pat. Nos. 4,260,389 and 4,289,496 to Lister describe controlled foam aqueous dyeing systems for various fibers and fabrics including garments made wholly of 100% polyester. Dyeing temperatures used are typically in the 80 to 100° C. range or as high as 140° C. The need to uniformly dye garments made of synthetic fiber and/or blended fiber fabric without allowing the dyeing process to set permanent creases and permanent wrinkles in the garment is not addressed.

Various non-aqueous high pressure dyeing procedures are also known in the art, for example Pittman et al U.S. Pat. No. 4,056,354 describes a non-aqueous system for dyeing fabrics of various fibers, including goods containing polyester, with disperse dye. Temperatures in the range of 110–165° C. are mentioned.

Pensa et al U.S. Pat. No. 4,828,571 describes a non-aqueous process for dyeing polyester fabrics or garments such as 100% polyester textured woven fabric shaped articles or garments at temperatures of 180–185° C. None of these documents indicate attention given to preventing permanent creases and wrinkles in the fabric or garment being treated during the dyeing operation nor are specific procedures used to select fabrics and/or garment constructions suited to preventing permanent creases and wrinkles in the fabric or garment during the dyeing process.

DESCRIPTION OF THE INVENTION

The present invention provides an aqueous-based dyeing process that uniformly dyes garments made of synthetic fiber and/or blended fiber fabric without allowing the dyeing process to set permanent creases and permanent wrinkles in the garment. Fabric selection and garment construction are taken into account when selecting candidate fabrics for the process. Dyeing is conducted in an aqueous system at elevated temperatures which is unusual for synthetic fiber-containing fabrics. The high temperature dyeing process typically consists of a series of numerous rotations or cycles in one or more dye baths. The inventive process has the effect of opening the garments through each rotation of the dye cycle so as to prevent the garment and fabric from being retained in the same relative configuration during its rotation through the dye bath.

High temperature dyeing of synthetic fiber and blended fiber fabrics in aqueous systems is not commonly used on a commercial scale. The process of this invention is carried out using dyeing temperatures generally in the range of 220 to 260° F., desirably 220° F. plus or minus 2° F. for 100% nylon fabrics and 260° F. plus or minus 2° F. degrees for polyester and polyester blend fabrics.

Fabrics particularly suited to the invention include synthetics such as polyester and nylon as well as synthetic blends such as polyester-wool, polyester-nylon, polyester-rayon, polyester-cotton as well as blends based on other regenerated cellulose rayons.

Selection of the fabric and its processing/preparation prior to dyeing is an important part of dyeing synthetics at high temperature (260° F./127° C.) in an aqueous system. The fabric must have a controllable, predictable shrinkage during the dye process to prevent permanent wrinkles, garment distortion and garment sizing problems. Fabric construction, picks and ends, type of yarn and type of weave are all important.

The invention is further explained with reference to the following non-limiting examples that are intended to further illustrate the invention.

DESCRIPTION OF THE PREFERRED EMBODIMENTS

Candidate synthetic fabrics and garment constructions are determined by a series of preliminary testing and selection steps. Initially the candidate greige fabric is assessed for suitability to the type of garment to be constructed. This includes fabric construction, potential for shrinkage variation and fabric shrinkage. Greige fabric shrinkage is based upon a lab scale boil-off test or prior experience with the particular fabric style. Acceptable garment dyeing includes management of shrinkage such that it is controlled in the warp and fill directions and also from lot to lot. Selection of the other garment components such as sewing thread, bindings and labels are all made to be compatible to the high temperature dyeing process. Acceptable fabrics preferably exhibit fabric regain (shrinkage) during dyeing of at most 6% and desirably less. Each fabric is evaluated for shrinkage using a laboratory boil off test with swatches scoured and desized at 205° F. If the shrinkage is 0 to 6% (warp/fill), then the fabric is prepared by prebulking/desizing and heat setting at 380 to 390° F. If the shrinkage is greater than 6% (warp and/or fill), then the fabric is prepared by prebulking/desizing, jet bulking at 260° F. and heat setting at 380 to 390° F. For shrinkage control and aesthetic purposes most fabrics are jet bulked.

A garment pattern is selected and appropriately resized based upon the information determined above, primarily on the shrinkage level. A garment is constructed and then measured to assure conformance to product specification as a means to compare with the garment size after completion of dyeing.

The garment is next dyed under elevated temperature conditions as defined above, usually about 260° F. For initial dyeing a liquid to goods ratio of 15:1 is used. Dyeing consists of 28 to 30 rotations in a modified Hutt dye process based on the fabric selected. Dyeing equipment from Tupesa/WTMC was used in the following examples. After dyeing is completed and the garment dried it is pressed and evaluated for shrinkage as well as other properties related to garment specifications and general appearance (aesthetics). The dyeing process is evaluated based upon several criteria including levelness of dyeing, shade, meeting specifications, overall garment appearance and the like.

In an illustrative dyeing process, the constructed garments (goods) are placed in a dyeing machine which is then filled with water at ambient/tap temperature to provide a solution to goods ratio of 15:1, then rotated at 28 rpm. This has the effect of opening the garment at least once during the dyeing process to keep the garment from being in the same relative configuration during the dyeing process. The water is heated to 100° F. and dye adjuvants, fixatives, surfactants and other dye and processing assists are added, then heated to 140° F. and held for 6 minutes. Dye is added slowly over a period of 10 minutes and the pH is checked, normally on the acid side in the range of 4.5 to 5.0. The dyebath is then heated over time to 180° F. at 30 per minute, 260° F. at 2° per minute and finally held at 260° F. for 30 minutes. Thereafter the dyebath is cooled down to 100° F. at a rate of 2° per minute. The container is drained, filled with warm water again at a liquid to goods ratio of 15:1 and agitated for 3 minutes. Water was extracted from the container and the dyed constructed garments were rinsed by filling with rinse water, agitating and extracting (for example, by a centrifuge), repeated as in the previous rinse, then extracted for 4 minutes and the garments removed.

A fabric swatch is processed first on the lab boil-off to evaluate its potential for shrinkage. Based on the results from the lab oil-off and the fabric specification required for garment making, the following successive manufacturing operations are needed. Prebulk/desize to remove size, wax and oil from the weaving operation. Next, jet beck bulk to obtain the maximum degree of fabric development (shrinkage). The final step is to heatset the fabric to stabilize and control the amount of shrinkage that will occur during the garment dyeing process. To verify that the fabric stability is suitable to garment dye, a 120° F. wash and press shrinkage test is performed.

Results for the above lab and manufacturing processing is listed below in the following examples as steps 1–4:

EXAMPLE 1

A plain weave polyester fabric was selected G/S (greige style) 1543/20, F/S (finish style) 3683, warp yarn 2/150 T242 disperse polyester, fill yarn 2/150 T242 disperse polyester, greige picks—44 per inch, greige width 76 inches. The fabric was then processed in the following successive steps:

| | Before | After | % Shrinkage |
|---|---|---|---|
| | 1. Lab boil-Off @ 205° F. | | |
| Picks | 44 | 62 | 30–34 Warp |
| Width | 76 | 56 | 26–30 Fill |
| | 2. Prebulk/Desize | | |
| Picks | 44 | 48 | |
| Width | 76 | 59 | |
| | 3. Jet Beck Bulk @ 260° F. for 30 minutes | | |
| Picks | 48 | 58 | |
| Width | 59 | 56 | |
| | 4. Heat Set @ 380° F. | | |
| Picks | 58 | 55–56 | |
| Width | 56 | 58–59 | |

Results show press shrinkage, that is warp shrinkage and fill shrinkage (W/F) of 1.93/1.20%, and 120° F., wash shrinkage W/F of 1.87/0.73% on the above prepared fabric. The same fabric after garment dyeing had wash shrinkage W/F of 4.5/4.1%. This indicates that this fabric is suitable for garment dyeing.

EXAMPLE 2

A plain weave fabric was selected G/S 2952/4, F/S 0348, warp yarn 2/75/25 T 242/T86 disperse/cationic dyeable polyester fill yarn 2/75/25 T 242/T86 disperse/ cationic dyeable polyester, greige picks θ44, and greige width 76 inches.

The fabric selected was then processed in the following successive steps:

| | Before | After | % Shrinkage |
|---|---|---|---|
| | 1. Lab boil-Off @ 205° F. | | |
| Picks | 44 | 56 | 22–27 Warp |
| Width | 76 | 56 | 19–21 Fill |
| | 2. Prebulk/Desize | | |
| Picks | 44 | 45 | |
| Width | 76 | 65 | |
| | 3. Jet Beck Bulk @ 260° F. for 30 minutes | | |
| Picks | 45 | 53 | |
| Width | 65 | 59 | |
| | 4. Meat Set @ 380° F. | | |
| Picks | 53 | 52–53 | |
| Width | 59 | 60–61 | |

Results on the above indicate the fabric has a press shrinkage W/F of 2.93/1.27% and 120° F. wash shrinkage W/F of 2.07/1.87%. The same fabric after garment dyeing has wash shrinkage W/F of 4.5/3.47%. This fabric is suitable for garment dyeing.

Fabric that has the potential to shrink at high temperature must be processed in a way as to allow this shrinkage to occur before fabric stability can be obtained.

Fabric construction and preparation are inter-related. The fabric preparation will be altered based on the fabric construction, yarn, etc. to meet the required fabric stability needed for garment dyeing. To illustrate, F/S 3683, 100% polyester would prebulk/desize, jet bulk at 260° F., and heat set at 380° F., while F/S 1027, 100% Nylon would prebulk/desize, jet bulk at 220° F., and relax dry at 250° F. Both of these fabrics are suitable for garment dyeing but differ in preparation.

The garment dye process is carried out in an aqueous system at 260° F. There is an inter-relationship between the liquid to fabric ratio and the amount of agitation required to prevent permanent wrinkles. The fabric must have enough buoyancy to move about and flow freely when agitated in the dyeing process to prevent wrinkles/compaction marks. The amount of agitation is also important, so the liquid to goods rates and agitation must be controlled. Successful trials have been completed using 15:1 liquid to goods ratio and a minimum of 28 rotations per minute. These conditions are maintained through the complete dyeing process.

We claim:

1. A process for dyeing garments constructed of synthetic fiber or blended fiber fabrics while avoiding permanent wrinkles and permanent creases in the garment, the process comprising the steps of:

(a) selecting a synthetic or synthetic blend fabric for the dyeing process whose fabric's shrinkage in the warp and fill directions is no greater than 6% or else processing said fabric to adjust the shrinkage to be no greater than 6% in the warp and fill directions;

(b) constructing a garment from the fabric in step (a);

(c) dyeing the constructed garment of step (b) in an aqueous dyebath at a temperature in the range of 220 to 260° F. for a time sufficient to achieve a desired shade and levelness of color; and then (d) drying and optionally pressing the dyed garment.

2. The process of claim 1 wherein prior to step (b) the fabric is desized, prebulked and heat set.

3. The process of claim 1 wherein during the dyeing step the garment is opened at least once during the dyeing process to keep the garment from staying in the same relative configuration during the dyeing process.

4. The process of claim 1 wherein the fabric is nylon or polyester.

5. The process of claim 1 wherein the fabric is a blend of polyester with rayon, wool or nylon.

6. The process of claim 1 wherein the fabric is a blend of nylon with rayon, wool or polyester.

7. The process of claim 1 wherein the synthetic fiber is polyester and the dyeing is conducted at a temperature of 260° F. plus or minus 2° F.

8. The process of claim 1 wherein the synthetic fiber is nylon and the dyeing is conducted at a temperature of 220° F. plus or minus 2° F.

* * * * *